United States Patent [19]

Strewe

[11] 4,078,984

[45] Mar. 14, 1978

[54] CIRCUIT OF MONOPOLAR ELECTROLYTIC CELLS

[75] Inventor: Wolfgang Strewe, Dortmund, Germany

[73] Assignee: Hooker Chemicals & Plastics Corporation, Niagara Falls, N.Y.

[21] Appl. No.: 755,872

[22] Filed: Dec. 30, 1976

[30] Foreign Application Priority Data

Jan. 13, 1976 Germany ..... 2601010

[51] Int. Cl.[2] ..... C25B 15/02; C25B 9/04

[52] U.S. Cl. ..... 204/228; 204/267

[58] Field of Search ..... 204/228, 267

[56] References Cited

U.S. PATENT DOCUMENTS

| | | | |
|---|---|---|---|
| 2,649,510 | 8/1953 | Michaelis | 204/228 X |
| 3,494,850 | 2/1970 | Druylants | 204/228 |
| 3,930,978 | 1/1976 | Strewe et al. | 204/228 |

FOREIGN PATENT DOCUMENTS

| | | | |
|---|---|---|---|
| 2,055,161 | 5/1971 | Germany | 204/228 |

*Primary Examiner*—John H. Mack
*Assistant Examiner*—D. R. Valentine
*Attorney, Agent, or Firm*—Peter F. Casella; Howard M. Ellis; Thomas T. Gordon

[57] ABSTRACT

A novel circuit of electrolytic cells, comprising novel monopolar cells with novel means of electrical cell to cell connections and electrical cell to jumper switch connections, resulting in a reduction of the necessary amount of highly conductive materials for these connections, and in a reduction of floor space required for the circuit, as well as in improved conditions for cell operation.

3 Claims, 4 Drawing Figures

CIRCUIT OF MONOPOLAR ELECTROLYTIC CELLS

BACKGROUND OF THE INVENTION

In the chemical industry, electrolytic cells are extensively used as apparatus for the production of different basic materials, such as hydrogen, oxygen, chlorine, alkalimetal hydroxides, chlorates, chlorites and others. Different types of electrolytic cells are in commercial use, for instance cells with horizontal or vertical anodes; cells with just one anode and cathode compartment, the so-called monopolar cells; as well as cells with a plurality of anode and cathode compartments electrically connected in series, the so-called bipolar cells.

Due to the limited product capacity of an individual cell, commercial plants normally comprise a plurality of electrolytic cells electrically connected in series, forming the so-called cell circuit. For instance, a chlor-alkali cell circuit, used for production of chlorine, hydrogen and alkali hydroxides, may comprise 50 to 100 cells or even more. Such circuits are equipped with intercell connectors between all cells, thus assuring a perfect current flow through the total circuit. The intercell connectors are made from highly conductive metals, for instance copper or aluminum. Each connector is attached to the cathode lead-out of one cell and the anode lead-in of the adjacent cell.

In many cases, but especially in the case of chlor-alkali cells, the life time of certain cell parts, such as anodes, diaphragms or other cell internals, is limited. This fact requires the removal of individual cells from time to time, and transportation to a cell workshop for replacement of the spent or exhausted cell parts. Normally such cell circuits are equipped with portable jumper switches for bypassing the electrical current around each incapacitated cell to the two adjacent cells, thus allowing steady operation of the cell circuit without any interruptions due to the incapacity of an individual cell.

Before removal of an incapacitated cell, the terminals of the jumper switch have to be connected to the cathode lead-out of one and the anode lead-in of the other adjacent cell. Then, by operating the switch, the incapacitated cell can be shut down and afterwards electrically disconnected from the two adjacent cells. This disconnection is performed by removal of the intercell connectors, the weight of each of them has to be limited. Therefore, for cells with high current rate, a plurality of single intercell connectors has to be provided. Normally these individual intercell connectors are disposed across the length of the gap between the cells. For removal or installation of the intercell connectors, this gap must have a certain clearance, allowing an operator to work inside it.

The necessity of such operation gaps between all cells is a certain disadvantage of conventional circuits of monopolar cells, especially when compared with circuits of bipolar cells. Bipolar cells comprise a plurality of anode and cathode compartments electrically connected in series, wherein the connection of adjacent anode and cathode compartments is executed by direct attachment of the backsides of these compartments. Thus, circuits of bipolar cells only need intercell connectors and operation gaps between the end compartment of one and the first compartment of the adjacent cell, and it is evident that the amount of material for intercell connectors, and the floor space requirement, are much lower than for circuits of monopolar cells for the same product capacity. For instance, a circuit of monopolar cells may comprise 100 cells operated at 100 kA. A circuit of bipolar cells for the same product capacity and operated at 100 kA may comprise 10 cells, each with 10 anode and 10 cathode compartments. In both cases the cells may be installed in two parallel rows, each row with one half the total number of cells. Consequently, the monopolar cell circuit comprises 98 operation gaps between the cells, whereas the bipolar cell circuit comprises eight operation gaps only. Thus, the amount of material for the inter-cell connectors of the monopolar cells is about 12 times higher than for the bipolar cells and the extension of the monopolar cell rows is at least 20 meters longer.

On the other hand, following this example, each bipolar cell has 10 times higher product rate, 10 times higher voltage drop and about 10 times higher weight than each monopolar cell. Due to these facts, different disadvantages occur for circuits of bipolar cells in cases where removal of individual cells during continuous operation of the circuit is necessary, as for instance in the chloralkaline electrolysis. During removal of a bipolar cell, the on-stream factor of the circuit is just 90%, compared to 99% during removal of a monopolar cell. The jumper switch of the bipolar cell circuit has to be designed for ten times higher voltage drop. The transport means for moving the bipolar cells between cell circuit and cell workshop, as well as the cell workshop itself, have to be designed in regard to the extremely high weight and volumes of these bipolar cells. Furthermore, construction of a bipolar cell is much more complicated than that of a monopolar cell and may result in more effort for maintenance and repair.

These disadvantages may be the main reasons that monopolar cell circuits dominate the important field of chloralkaline electrolysis.

SUMMARY OF THE INVENTION

It is the object of this invention to provide a novel circuit of monopolar cells with a minimum operation gap between the cells, resulting in a significant reduction of material necessary for the intercell connectors, and simultaneously in a significant reduction of floor space requirement, thus approaching the main advantages of bipolar cell circuits but omitting the different disadvantages of such bi-polar cell circuits as mentioned above.

This problem is solved by a circuit of electrolytic cells comprising a plurality of monopolar electrolytic cells electrically connected in series, and connected to each other by intercell connectors, said cells each having an anode lead-in and a cathode lead-out, said circuit further comprising at least one movable jumper switch including connectors for electrically connecting two cells located adjacent an incapacitated cell, said jumper switch being disposed beneath said cells, characterized in that said cathode lead-outs are prolonged beneath the level of the cell bottoms and are provided at their prolonged areas with contact faces for contact pieces of the intercell connectors and with contact faces for switch connectors, that said intercell connectors can be connected to said switch connectors via contact faces, that said contact faces are arranged so that they are accessible from the cell bottom, and that the individual cells are arranged in series with a minimum clearance.

The novel circuit of monopolar cells of this invention may be used for different kinds of electrolysis, but a main application will be the electrolysis of brine for the production of chlorine, hydrogen and alkali metal hydroxides in diaphragm cells with vertical electrodes. Therefore, the following detailed description of the invention is related to this well-known type of electrolysis cells.

In accordance with this invention, the problem of omitting the operation gap between the cells is solved by a new design of the cathode lead-out part of the cells in connection with an appropriate cell shape, and an appropriate jumper switch arrangement. Conventional vertical electrode cells have a shape that is nearly square, which means that the cell width (extension of the cell in direction of the cell row) is about equal to the cell length (extension of the cell perpendicular to the direction of the cell row.) The jumper switch in conventional circuits of vertical electrode cells is positioned in an operation aisle beside the cell row. In such conventional circuits with such conventional cells, an operation gap between all cells is inevitable. But, according to a new cell design as described in U.S. patent application Ser. No. 542,537, filed Jan. 20, 1975, now U.S. Pat. No. 4,017,376, it is possible to provide vertical-electrode cells with a high aspect ratio of cell length to cell width, and regarding to a new jumper switch arrangement as described in U.S. patent application Ser. No. 542,650, filed Jan. 20, 1975, now U.S. Pat. No. 3,930,978, issued Jan. 6, 1976, it is possible to position the switch beneath a cell row instead of beside it. For such new cell shapes and such new jumper switch arrangements it is possible to provide cell circuits without operation gaps between the cells when using the new cathode lead-out design of this invention.

It is essential for this invention that the cell circuit comprises a plurality of monopolar cells positioned in at least one row and located at a height over the ground floor sufficient for installing at least one portable jumper switch on the ground floor beneath the cell row, and for working of the operators on the ground floor during renewal of an incapacitated cell, and that all cell parts serving for the electrical connection of the cells and the jumper switch, i.e. the cathode lead-out and anode lead-in contact areas for intercell connectors and jumper switch terminals as well as the intercell connectors themselves, are positioned beneath the bottom of the cells, so that these cell parts are accessible for an operator positioned on the ground floor. Furthermore, it is essential for this invention that the cells have sufficient length, permitting simultaneous attachment of the intercell connectors and the switch connectors to the contact areas disposed across the lengths of the cells, especially if, as in a preferred embodiment of this invention, intercell connectors and switch connectors are disposed alternately, side by side.

DESCRIPTION OF THE DRAWINGS

The present invention will be more fully described by reference to the drawings in which:

FIG. 1 shows a part of a circuit of monopolar cells according to this invention. The cells comprise a cell bottom 1, a cell enclosure 2 containing the anode and cathode compartment, and the cell top 3. The current enters a cell through the intercell connectors 4 and the anode lead-in 5, then passes through the anode and cathode compartment of the cell enclosure 2, leaves the cell through the cathode lead-out 6, enters the next intercell connector 4 and so forth. The portable jumper switch 7 is shown in a position whereby it is connected with the left and the right cells of the figure by means of the switch connectors 8 and 9. In this situation, the jumper switch can bypass the electrical current around the middle cell of the figure. According to this invention, the cathode lead-out of the cells is prolongated beneath the level of the cell bottom 1 and the contact area 10 of the intercell connectors 4 as well as the contact area 11 of the switch connectors 8 are provided at this prolongation of the cathode lead-out 6. The switch connectors 9 are attached to the intercell connectors 4 at the contact area 12. It is evident that all contact areas 10, 11, and 12 are accessible for an operator positioned on the ground floor. That means that all necessary operations of connecting and disconnecting of the intercell and switch connectors to the contact areas during renewal of a cell can be done from the ground floor, so that it is not necessary to provide large operation gaps between the cells. Therefore, the cells are set close together in the cell row, separated just by a small clearance, sufficient for easy lifting of an incapacitated cell and easy positioning of a new cell. The cathode lead-out 6 may be formed from any suitable electrically conductive materials, for instance steel or copper, or from compounds of such materials. The intercell connectors 4, and the switch connectors 8 and 9, may be preferably formed from highly electrically conductive materials, such as copper or aluminum, and as a plurality of individual flexible busbars, thus facilitating the connection to, and the disconnection from, the contact areas.

FIG. 2 shows a partial view of that side of the cathode lead-out 6 where the intercell connectors 4 are attached. In this specific design, each grouping of four intercell connectors 4 ends in a contact piece 13, which is attached by means of threaded bolts 14, nuts 15 and pressure plates 16 to the contact area 10. The contact pieces 13 comprise tongues 17, which serve for the connection of the switch connectors 9, alternatively, etc.

FIG. 3 shows a partial view of that side of the cathode lead-out 6 where the switch connectors 8 can be attached, that is the side opposite to that shown in FIG. 2. In this specific design, the switch connectors 8 are attached to the cathode lead-out 6 in such a manner that the center lines of the switch connectors are located exactly in the middle between the center lines of the contact pieces 13. By this arrangement it is assured that the switch connectors do not interfere with the threaded bolts 14 and nuts 15, serving for the attachment of the contact pieces 13 on the opposite side of the cathode lead-out 6.

FIG. 4 shows a typical cell room layout of a cell circuit according to this invention. The circuit comprises 100 cells no. 1,2,3. . . , 100, installed in two rows. The circuit is operated at 100 kA, thus representing a daily production rate of about 300 metric tons chlorine, a medium capacity for chlorine plant. Each cell has a width of 0.9 meter, and between the cells a clearance of 0.1 meter is provided. Thus, the total length of a cell row is about 50 meters. The length of the cells is about 5 meters so that with respect to this dimension and the operation aisles between and outside the cell rows, a cell room width of about 20 meters is necessary. This means that the floor space requirement of this circuit of 100 cells is about 1000 square meters.

The above figures illustrate the different advantages of the present invention. It is evident that all operations for connecting or disconnecting cells and a jumper switch during a cell renewal can be done from the ground floor, where there is sufficient space around the jumper switch for easy and safe execution of this work. In cell circuits of the prior art, the operators are forced to do this renewal work inside the narrow operation aisle between the cells, with limited freedom of movement for handling tools and connector parts and exposure to the intensive heat radiation of the cells. Thus, cell circuits of the present invention provide improved working conditions for the cell operators, guaranteeing more safety and reduction of physical exertion during cell renewal work.

Figure 1:
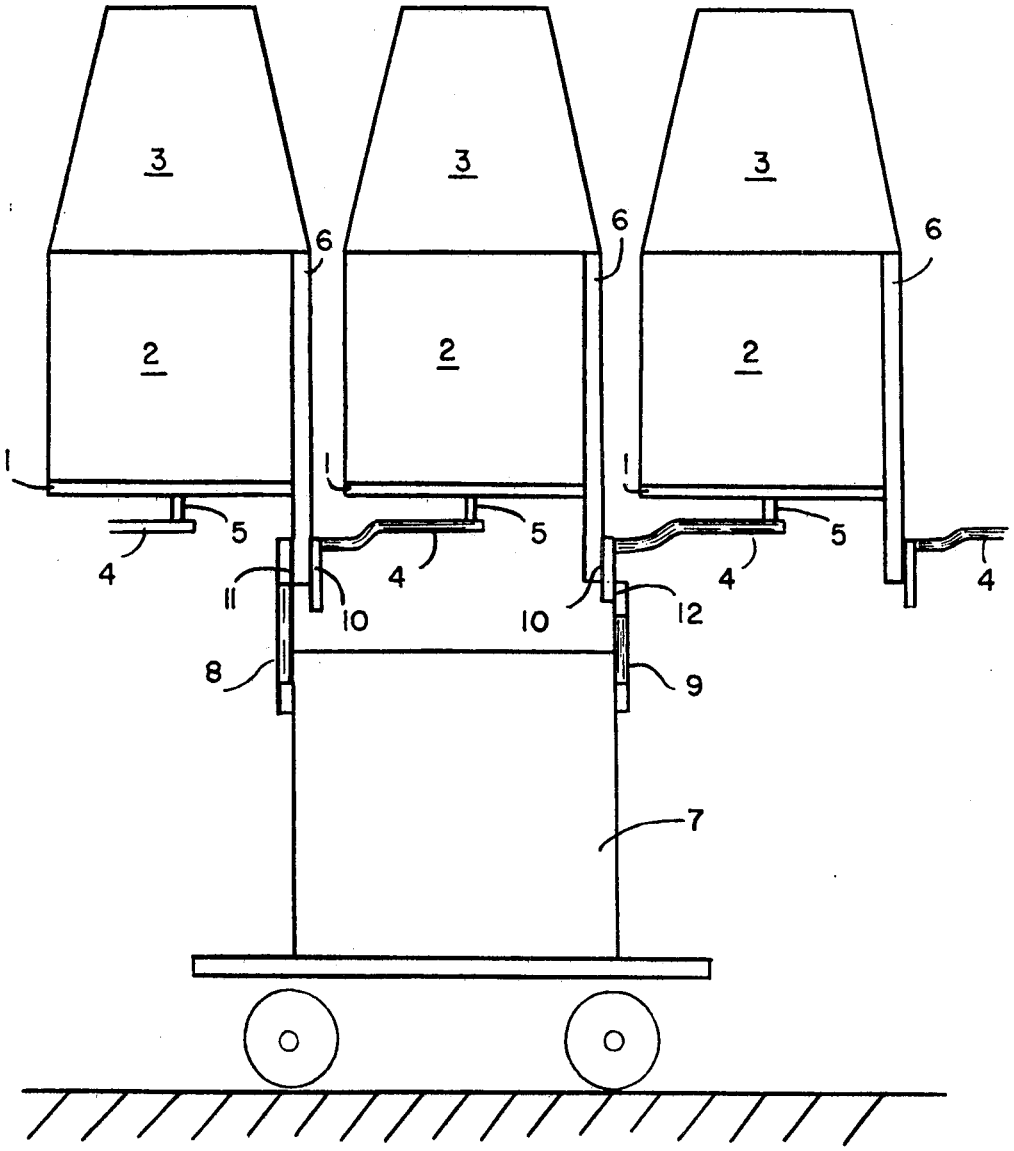
FIG. 1 represents a partial view of a circuit of monopolar cells in accord with the present invention.
Figure 2:
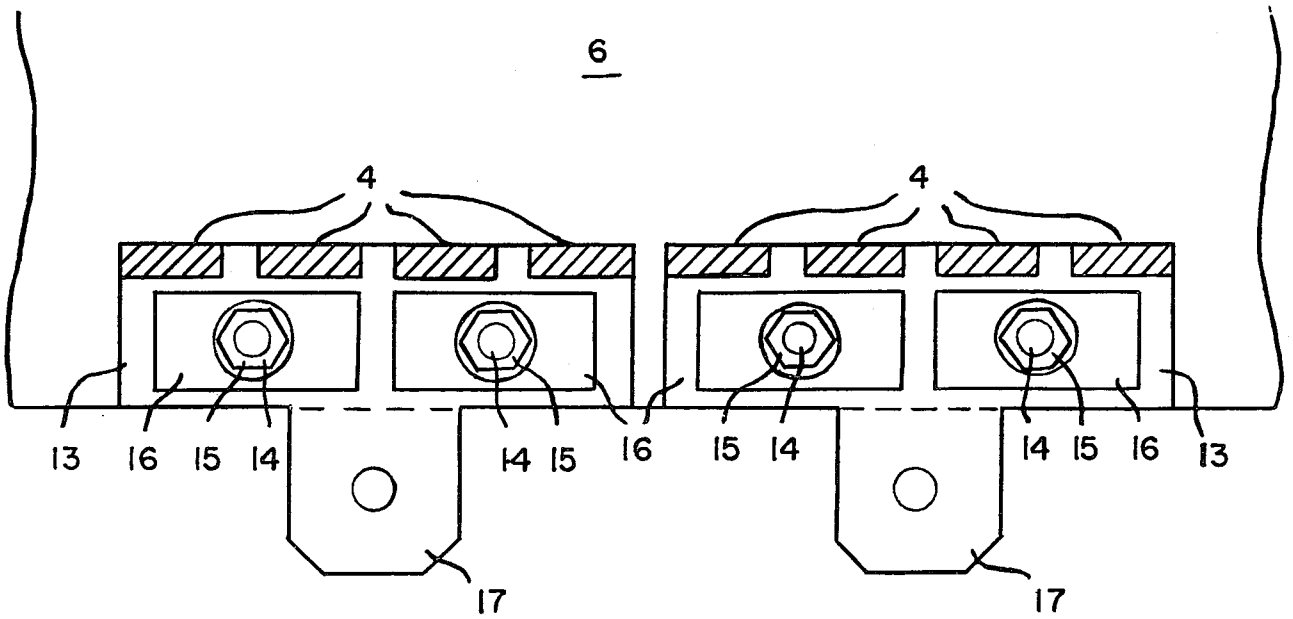
FIG. 2 is a partial view of a typical cathode lead-out design according to the present invention.
Figure 3:
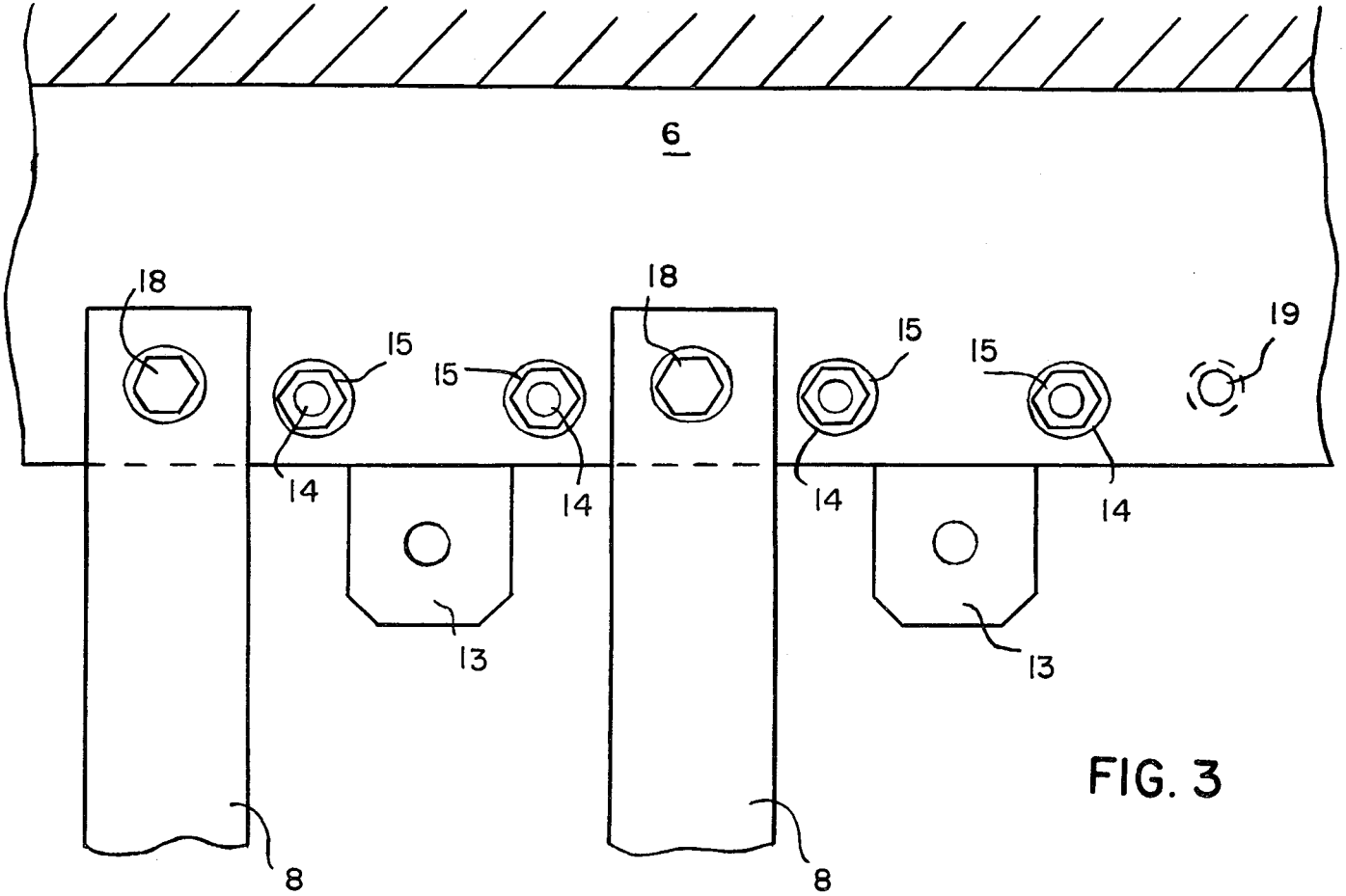
FIG. 3 is another partial view of a typical cathode lead-out design according to the present invention.
Figure 4:
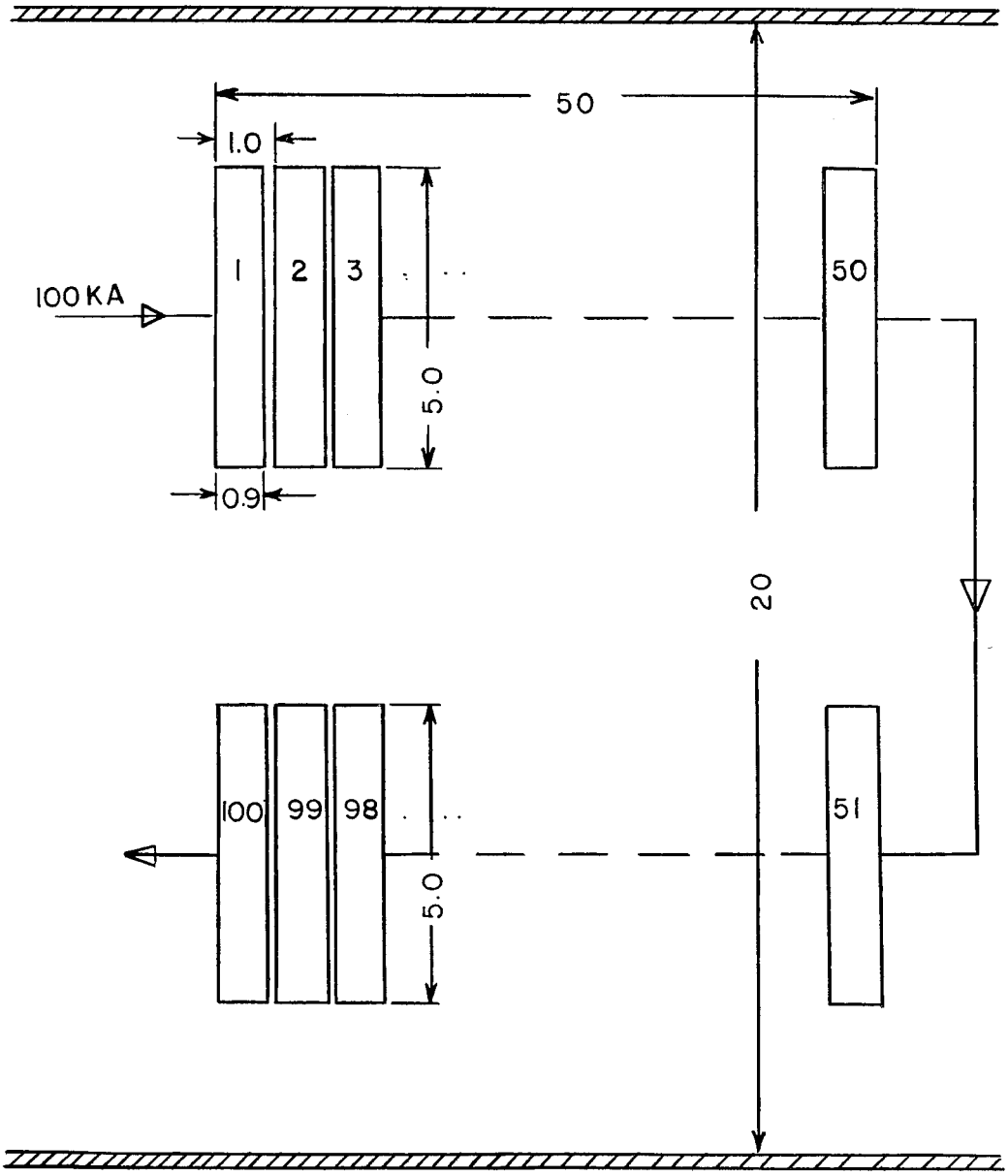
FIG. 4 represents a typical cell room layout according to the present invention.

Moreover, cell circuits of the present invention require much less floor space compared to monopolar cell circuits of the prior art. Following the example demonstrated in FIG. 4, the floor space requirement of this cell circuit of 100 cells operated at 100 kA is about 1000 square meters. On the other hand, a cell circuit of the prior art with the same cell number, cell size and amperage, arranged in two rows, would require a clearance between the cells of at least about 0.6 meter for providing the necessary operation gap. Thus, the total length of the cell row is about 75 meters, and with the cell room width of 20 meters, the floor space requirement is about 1500 square meters. It is evident that by the present invention, for cell circuits with a chlorine production of 300 metric tons per day, a floor space saving of about 500 square meters is assured. More generally, independently of the production rate, cell circuits of the present invention can approach floor space savings of about 30% compared to monopolar cell circuits of the prior art.

A further advantage of cell circuits of the present invention is the significant reduction of the amount of necessary highly conductive material for the intercell connectors. Following again the example of FIG. 4, for the current transport of 100 ka from cell to cell, a total cross section of about 500 $cm^2$ for the intercell connectors has to be provided, if the connectors are made from copper. This large cross section is necessary to limit the voltage drop and the heat generation of the intercell connectors. Regarding the difference of the cell to cell clearance between a cell circuit of the present invention and one of the prior art, which is 0.5 meter, the total reduction of the length of the intercell connectors for the complete circuit is about 50 meters, corresponding to a savings of copper material for the total circuit of more than 20,000 kilograms, a substantial cost reduction. More generally, independently of the production rate, cell circuits of the present invention can approach copper material savings of about 2 kg per kA and per cell compared to monopolar cell circuits of the prior art.

The reduction of length of the intercell connectors consequently results in reduction of voltage losses, power losses, and heat generation, too. Following again the example, demonstrated in FIG. 4, cell circuits of the present invention can approach power savings of about 15 kWh per metric ton of produced chlorine compared to monopolar cell circuits of the prior art.

The circuit of monopolar cells of the present invention as described above for various electrolysis processes thus permits improved cell operation, results in lower requirements of cell room floor areas, and or highly conductive materials, and consequently reduces capital investment and operating costs compared to the prior art.

The invention has been described with respect to specific examples and illustrative embodiments, but it is to be understood that the invention is not to be thusly limited. It is evident that one of ordinary skill in the art will readily recognize substitutes and equivalents without departure from the spirit of the invention or the scope of the following claims.

What is claimed is:

1. A circuit of electrolytic cells installed in electrical series, comprising a plurality of vertical electrode monopolar cells disposed in at least one row so that the cathode lead-out, the intercell connectors, and the anode lead-in are uniformly disposed across substantially the entire length of the cell and beneath the bottom of each cell, accessible from a work area beneath the cell row, said cell circuit adapted to receive at least one portable jumper switch beneath a cell row and movable along the center line of said row, said portable jumper switch having connectors on one terminal attachable to the cathode lead-out of any given cell and on the other terminal attachable to the anode lead-in of the cell once removed from said given cell, said cathode lead-out, intercell connectors, anode lead-in and switch connectors arranged so that during removal of an incapacitated cell all operations for connecting and disconnecting the jumper switch and for connecting and disconnecting the intercell connectors to and from the adjacent cells can be executed from the work area beneath the cell row, and the contact areas for the attaching intercell connectors and jumper switch are provided on opposite sides of the cathode lead-out.

2. A circuit of electrolytic cells according to claim 1 wherein the contact pieces of the switch connectors and the contact pieces of the intercell connectors are disposed alternately across the length of the cathode lead-out.

3. A circuit of electrolytic cells according to claim 1 wherein the clearance between two adjacent cells in a cell row is 0.1 meter or less.

* * * * *

UNITED STATES PATENT OFFICE

CERTIFICATE OF CORRECTION

Patent No. 4,078,984 Dated March 14, 1978

Inventor(s) Wolfgang Strewe

It is certified that error appears in the above-identified patent and that said Letters Patent are hereby corrected as shown below:

In the Drawings, Sheet 1

The patent number should be 4,078,984.

Signed and Sealed this

*Eighth* Day of *August 1978*

[SEAL]

*Attest:*

RUTH C. MASON
*Attesting Officer*

DONALD W. BANNER
*Commissioner of Patents and Trademarks*